US008699866B2

(12) United States Patent
Lee et al.

(10) Patent No.: US 8,699,866 B2
(45) Date of Patent: Apr. 15, 2014

(54) HEATING APPARATUS

(75) Inventors: Sanghun Lee, Changwon (KR); Song Choi, Changwon (KR)

(73) Assignee: LG Electronics Inc., Seoul (KR)

( * ) Notice: Subject to any disclaimer, the term of this patent is extended or adjusted under 35 U.S.C. 154(b) by 572 days.

(21) Appl. No.: 12/992,912

(22) PCT Filed: May 4, 2009

(86) PCT No.: PCT/KR2009/002355

§ 371 (c)(1),
(2), (4) Date: Nov. 16, 2010

(87) PCT Pub. No.: WO2010/128692

PCT Pub. Date: Nov. 11, 2010

(65) Prior Publication Data

US 2011/0081139 A1 Apr. 7, 2011

(30) Foreign Application Priority Data

May 4, 2009 (KR) ..... 10-2009-0038943

(51) Int. Cl.
*H05B 3/00* (2006.01)

(52) U.S. Cl.
USPC ..... 392/465; 392/470; 392/478; 392/480; 392/482; 165/148; 165/152

(58) Field of Classification Search
USPC ..... 392/465, 470, 478–484; 165/148, 151, 165/152, 168, 169, 170, 171
See application file for complete search history.

(56) References Cited

U.S. PATENT DOCUMENTS

| | | | | |
|---|---|---|---|---|
| 4,815,532 | A * | 3/1989 | Sasaki et al. | 165/152 |
| 5,352,870 | A * | 10/1994 | Daugherty et al. | 219/549 |
| 5,894,884 | A * | 4/1999 | Durian et al. | 165/132 |
| 6,912,357 | B2 * | 6/2005 | Bissonnette et al. | 392/465 |
| 7,330,645 | B2 * | 2/2008 | Kwon | 392/456 |
| 2003/0188539 | A1 * | 10/2003 | Abras et al. | 62/3.3 |

FOREIGN PATENT DOCUMENTS

| | | | |
|---|---|---|---|
| JP | 09-134779 | A | 5/1997 |
| JP | 2002-527254 | A | 8/2002 |
| JP | 2005-001447 | A | 1/2005 |
| JP | 2008-238090 | A | 10/2008 |

OTHER PUBLICATIONS

Yeo-Hwan Yoon, "Transparent Film Heater Using Single-Walled Carbon Nanotubes", Aug. 14, 2007, Advanced Materials, Wiley InterScience, pp. 4284-4287.*
PCT International Search Report dated May 18, 2010 issued in Application No. PCT/KR2009/002355.

* cited by examiner

*Primary Examiner* — Dana Ross
*Assistant Examiner* — James Sims, III
(74) *Attorney, Agent, or Firm* — McKenna Long & Aldridge LLP

(57) ABSTRACT

Disclosed is a heating apparatus. In the heating apparatus, carbon nanotube heating elements for heating fluid flowing through a flow channel in a heating chamber are disposed at a heat transfer part. The contact area of the carbon nanotube heating elements and the heat transfer part is 50% or more of the contact area of the heat transfer part and the fluid. Therefore, it is possible to more efficiently heat the fluid.

10 Claims, 4 Drawing Sheets

HEATING APPARATUS

CROSS REFERENCE TO RELATED APPLICATIONS

This application claims priority to Korean Patent Application Nos. 10-2009-0038943 filed on May 4, 2009, the entire contents of which are herein incorporated by reference.

BACKGROUND OF THE INVENTION

1. Field of the Invention

The present invention relates to a heating apparatus, in more detail, a heating apparatus that heats fluid.

2. Description of the Related Art

Heating apparatuses heat fluid using a variety of heaters.

In general, as the heating apparatuses that heat a small amount of fluid, sheath heaters or PTC heaters (Positive Temperature Coefficient Heaters) are used. However, the sheath heaters or PTC heaters have a problem in that they have relatively low thermal efficiency and many restrictions in geometric design.

It is an object of the present invention to provide a heating apparatus that can more effectively heat fluid.

It is another object of the present invention to provide a heating apparatus that makes it possible to design various heaters.

SUMMARY OF THE INVENTION

In order to accomplish the objects of the present invention, a heating apparatus according to an embodiment includes: a heating chamber where a flow channel through which fluid flows is formed; a heat transfer part that transmits heat to the fluid flowing through the flow channel; and a plurality of carbon nanotube heating elements that generates heat which is transmitted to the fluid through the heat transfer part, by receiving power, in which the sum of contact areas of the carbon nanotube heating elements and the heat transfer part is 50% or more of the contact areas of the heat transfer part and the fluid.

A heating apparatus according to another embodiment of the present invention includes: a heating chamber where a flow channel through which fluid flows is formed; a heat transfer part of which one side is in contact with the fluid flowing through the flow channel; two electrodes that are disposed on the other side of the heat transfer part and connected with a power source; a plurality of carbon nanotube heating elements that are disposed apart from each other on the other side of the heat transfer part such that the electrodes are respectively connected, and generates heat by power applied through the electrodes; and an insulating member that insulates the electrodes and the carbon nanotube heating elements, in which the sum of contact areas of the carbon nanotube heating elements and the heat transfer part is 50% or more of the contact areas of the heat transfer part and the fluid.

According to the present invention, it can more efficiently perform the efficient heating.

DETAILED DESCRIPTION OF THE PREFERRED EMBODIMENTS

The configuration of a first embodiment of a heating apparatus according to the present invention is described hereafter in detail with reference to the accompanying drawings.

Figure 1:
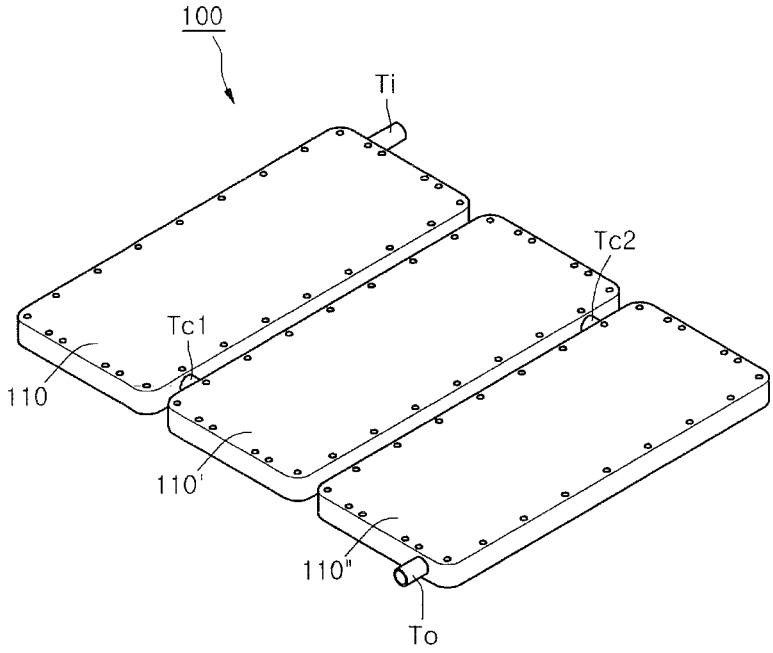
FIG. 1 is a perspective view showing a first embodiment of a heating apparatus according to the present invention.
Figure 2:
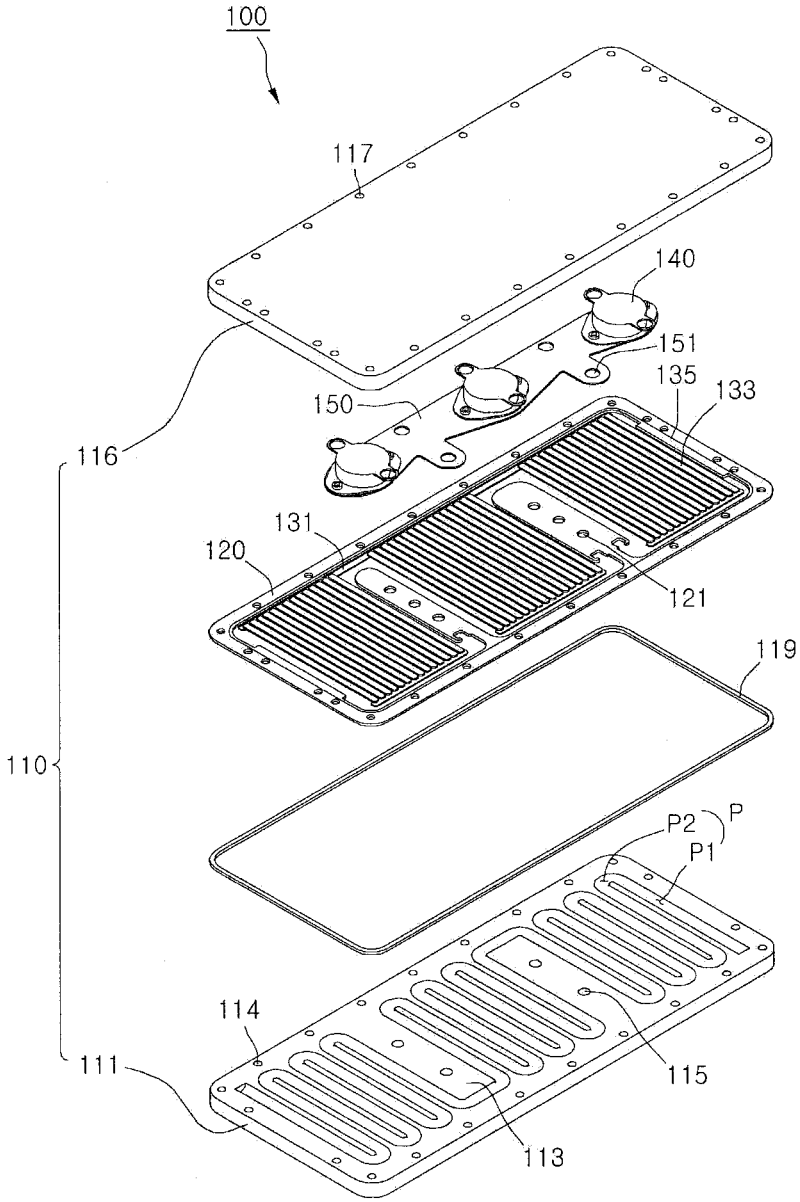
FIG. 2 is an exploded perspective view showing the first embodiment of the present invention.

FIG. 1 is a perspective view showing a first embodiment of a heating apparatus according to the present invention and FIG. 2 is an exploded perspective view showing the first embodiment of the present invention.

Referring to FIGS. 1 and 2, a heating apparatus 100 includes a heating chamber 110, a plurality of heat generating parts, and a heat transfer part 120. The heat generating parts and the heat transfer part 120 are formed in one unit in the heating apparatus 100. A flow channel P is provided in the heating chamber 110. The heat generating parts generate heat to heat fluid flowing through the flow channel P and the heat transfer part 120 transfers the heat of the heat generating parts to the fluid.

In this embodiment, as shown in FIG. 1, the heating chamber 110 includes first to third heating chambers 110, 110', 110". The first heating chamber 110 receives fluid through an inlet tube Ti, and the first and second heating chambers 110, 110' are connected by a first connecting tube Tc1. Further, the second and third heating chambers 110', 110" are connected by a second connecting tube Tc2 and the third heating chamber 110" passes the fluid through an outlet tube To. This is for adjusting the number of heating chambers 110, 110', 110" in accordance with the needed heating amount of fluid.

Meanwhile, referring to FIG. 2, the heating chamber 110 includes a chamber main body 111, a chamber cover 116, and a plurality of sealing members 119. The chamber main body 111 and the chamber cover 116 may be made of heat-resistant synthetic resin. Further, when the chamber main body 111 and the chamber cover 116 are made of metal, a heat insulator for insulating the fluid flowing through the flow channel P may be additionally provided.

The chamber main body 111 is formed substantially in a polyhedron shape with one side open. A predetermined space for forming the flow channel P is formed in the chamber main body 111.

Further, a plurality of section ribs 112 is provided in the chamber main body 111. The section ribs 112 divide the inside of the chamber main body 111 such that the flow channel P entirely meanders. In detail, the section ribs 112 are formed long in the inner short side direction of the chamber main body 111 in the chamber main body 111. One end of the section rib 112 is connected to one end in the long side direction of the chamber main body 111 and the other end of the section rib 112 is spaced apart from the other end in the long side direction of the chamber main body 111.

On the other hand, the flow channel P meandering by the section ribs 112 has a plurality of straight sections P1 and connecting sections P2. The straight sections P1 are formed long in the short side direction of the chamber main body 111 and the connecting sections P2 connect ends of two adjacent straight sections P1 in the long side direction of the chamber main body 111.

Some of the section ribs 112, that is, in this embodiment, two section ribs 112 are formed to have a large width relatively to the other section ribs 112. Hereinafter, for the convenience of description, the section ribs 112 having a relatively large width in the section ribs 112 are referred to as fixing ribs 113.

The chamber main body 111 is provided with two communicating holes (not shown) that are communicated with both ends of the flow channel P. The communicating holes are connected to the inlet tube Ti through which fluid flows from the outside or the outlet tube To through which the heated fluid flows outside, or connected with the first or second connecting tube Tc1, Tc2.

Further, a plurality of first and second fastening holes 114, 115 are formed respectively at the edge of the chamber main body 111 and the fixing ribs 113. The fastening holes 114 are for fixing the chamber cover 116 and the second fastening holes 115 are for fixing the heat transfer part 120.

On the other hand, the chamber cover 116 is formed to have a size and a shape that can cover the open side of the chamber main body 111. Further, the chamber cover 116 is fastened by fasteners (not shown), with the edge of one side being in close contact to the edge of the chamber main body 111. For this structure, first through-holes 117 are formed in the chamber cover 116. The first through-holes 117 are portions through which the fasteners inserted in the first fastening holes 114 pass.

The sealing member 119 prevents the flow flowing through the flow channel P from leaking. The sealing member 119 is positioned between the chamber main body 111 and the chamber cover 116, in detail, between the edge of the chamber main body 111 and the edge on one side of the chamber cover 116, which are in close contact with each other.

The heat transfer part 120 is positioned inside the heating chamber 110, that is, between the chamber main body 111 and the chamber cover 116. The heat transfer part 120 transmits the heat of the heat generating parts to the fluid flowing through the flow channel P. The heat transfer part 120 forms the flow channel P together with the chamber main body 111. Accordingly, the fluid flowing through the flow channel P contacts with one side of the heat transfer part 120. For this, the heat transfer part 120 is made of a material having predetermined heat conductivity and formed to have a size and a shape that can cover the inside of the chamber main body 111.

Accordingly, in this embodiment, the heat transfer part 120 is formed in a rectangular metal plate shape. Further, a plurality of through-holes 121 is formed in the heat transfer part 120.

The second through-holes 121 is portions through which fasteners (not shown) inserted in the second fastening holes 115 pass to fix the heat transfer part 120.

A heat generating part is provided on the other side of the heat transfer part 120 which corresponds to the opposite side to the side of the heat transfer part 120 which contacts with the fluid flowing through the flow channel P. In this embodiment, the heat generating part includes two electrodes 131, a plurality of carbon nanotube heating elements 133, and an insulating member 135.

In detail, the electrodes 131 are disposed apart from each other on the other side of the heat transfer part 120. In this embodiment, the electrodes 131 are formed long in the long side direction of the heat transfer part 120 and spaced apart from each other in the short side direction of the heat transfer part 120.

Further, the carbon nanotube heating element 133 (hereafter, referred to as 'CNT heating element') implies a material formed of a carbon nanotube having a tube shape formed by hexagons composed of six carbons and connected with each other. The CNT heating elements 133 are formed long in the short side direction of the heat transfer part 120 and spaced apart from each other in the width direction of the hat transfer part 120. In this configuration, the CNT heating elements 133 are disposed throughout the regions of the heat transfer part 120 which contact with the fluid flowing through the flow channel P, except for the regions corresponding to the fixing ribs 113. The reason that the plurality of CNT heating elements 133 are provided is for normally operating the other CNT heating elements 133, even if any one or more of the CNT heating elements 133 is disconnected. Further, both ends of the CNT heating elements 133 are connected to the electrodes 131, respectively. In this configuration, the gap between adjacent CNT heating elements 133 is determined at the width of the CNT heating elements 133 in the short side direction of the heat transfer part 120, or less. Further, the sum of the contact areas with the heat transfer part 120 of the plurality of CNT heating elements 133 is determined at least 50% or more of the areas where the heat transfer part 120 contacts with the fluid flowing through the flow channel P. This is for maximally heating the fluid flowing through the flow channel P within a range preventing the disconnection of the CNT heating elements 133.

Further, the insulating member 135 insulates the electrodes 131 and the CNT heating elements 133. For example, the insulating member 135 may be applied or coated throughout the other side of the heat transfer part 120 where the electrodes 131 and the CNT heating elements 133 are disposed.

Further, the heating apparatus 100 includes three bimetals 140 to prevent overheat of the CNT heating elements 133. The bimetals 140 cut the power applied to the CNT heating elements 133, when the temperature of the CNT heating elements 133 becomes larger than a predetermined safe temperature. In this embodiment, the bimetals 140 are fixed to a mounting bracket 150 and the mounting bracket 150 is fixed to the chamber main body 111 together with the heat transfer part 120. For this structure, a plurality of third through-holes 151 is formed through the mounting bracket 150. Further, the fasteners passing through the third through-holes 151 and the second through-holes 121 are inserted in the second fastening holes 115. In this embodiment, the bimetals 140 substantially detects the inside temperature of the heating chamber 110. However, the bimetals 140 may directly detect the temperature of the CNT heating elements 133.

On the other hand, a single-phase or a 3-phase input power source may be connected to the electrodes 131, in accordance with the output of the CNT heating elements 133. For example, a single-phase input power source is connected, when the output of the CNT heating elements 133 is 4 kW or less, and a 3-phase input power source can be connected, when the output is 4 kW or more.

The operation of the first embodiment of a heating apparatus according to the present invention is described hereafter in detail with reference to the accompanying drawings.

Figure 3:
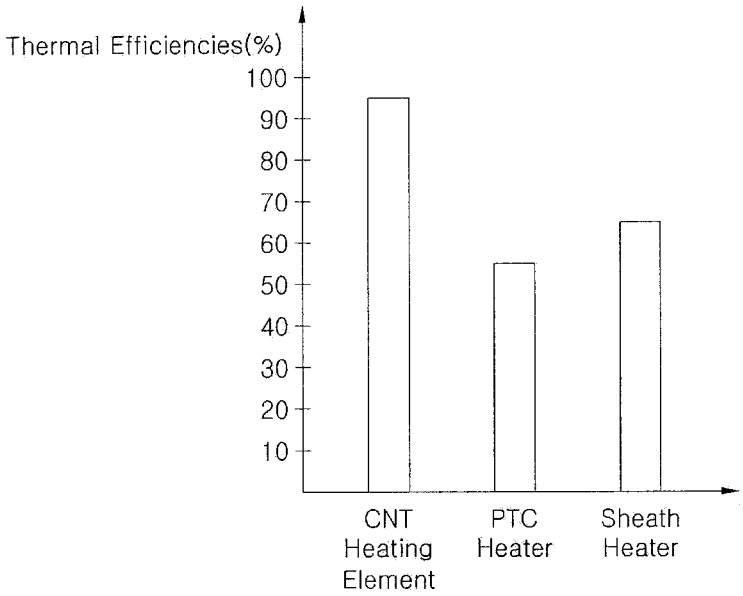
FIG. 3 is a graph illustrating thermal efficiencies according to the types of heaters.

FIG. 3 is a graph illustrating thermal efficiencies according to the types of heaters.

First, fluid flows into the heating chamber 110, that is, into the flow channel P through the inlet tube Ti. The fluid flowing in the flow channel P flows through the flow channel P and then flows outside the heating chamber 110 through the outlet tube To. Further, when a plurality of heating chambers 110 is provided, the fluid flows along the flow channels P of the plurality of heating chambers 110 through the connecting tubes Tc1, Tc2.

When power is supplied, the CNT heating elements 133 generate heat. The heat of the CNT heating elements 133 is transmitted to the fluid flowing through the flow channel P, through the heat transfer part 120. That is, the fluid flowing through the flow channel P is heated by the CNT heating elements 133.

However, in this embodiment, the CNT heating elements 133 are configured such that they maximally heat the fluid flowing through the flow channel P within a region that can prevent disconnection among them. Therefore, it is possible to more stably and efficiently heat the fluid flowing through the flow channel P by using the CNT heating elements 133.

Further, when the CNT heating elements 133 are overheated, the power that is applied to the CNT heating elements 133 is cut by the bimetals 140. Accordingly, it is possible to remove problems due to overheat of the CNT heating elements 133, and for example, it is possible to prevent overheat of the fluid flowing through the flow channel P or damage to the heat transfer part 120 or the heating chamber 110.

On the other hand, referring to FIG. 3, it can be seen that the thermal efficiency of the CNT heating element 133 is relatively higher than those of a PTC (Positive Temperature Coefficient) heater and a sheath heater which are heating sources used for heating the fluid. In other words, when the same energy is applied, the CNT heating element 133 achieves around about 95% thermal efficiency, but the PTC heater achieves about 55% thermal efficiency and the sheath heater achieves 65% thermal efficiency.

Further, the CNT heating element 133 can be changed in design in various shapes, as compared with the sheath heater. Furthermore, the CNT heating element 133 can easily ensure rigidity, as compared with the PTC heater. Therefore, it can be said that the CNT heating element 133 has an excellent advantage in thermal efficiency, as compared with typical PTC heaters or sheath heaters of the related art.

It should be understood that the present invention can be modified in various ways by those skilled in the art, within the basic technical spirit of the present invention, and the scope of the present invention should be construed on the basis of the accompanying claims.

Although total three bimetals are provided in the above embodiments, it is not limited thereto. That is, the number of bimetals can be differently determined in accordance with the size of the heating chamber.

Further, although three heating chambers are provided and spaced apart from each other in the short side direction, the number and the arrangement direction of the heating chambers are not limited thereto.

As described above, the air conditioning system according to the present invention can obtain the following effects.

First, in the present invention, the refrigerant is sucked into the compressor in a state heated by the refrigerant heater in the heating mode. Therefore, the sufficient heating efficiency can be secured.

In the present invention, the refrigerant is heated by the carbon nanotube heating element. Therefore, the refrigerant can be more efficiently heated by the carbon nanotube heating element.

In the present invention, the heating chamber forming the passage in which the refrigerant flows and the carbon nanotube heating element are configured in a single unit. Therefore, the configuration of the heater is more simplified, such that the heater is easily installed.

In addition, in the present invention, the plurality of heating chambers can be used by being connected to each other according to the required heating amount. Therefore, the design of the heater can easily be changed according to the required heating amount.

In the present invention, the total sum of the contacting area of the plurality of CNT heating elements and the heat transferring part contacting the refrigerant or the operating fluid is determined to be 50% or more of the contacting area of the heat transferring part contacting the refrigerant or the operating fluid. In addition, the interval between the carbon nanotube heating elements is determined to the width or less of the carbon nanotube heating element. Therefore, the carbon nanotube heating element can maximally heat the fluid in the range where the thermal deformation of the heat transferring unit can be prevented.

In addition, in the present invention, the fluid in which the refrigerant or the operating fluid flows is substantially formed in a spiral shape and the carbon nanotube heating element is disposed in a direction parallel to a direction in which the refrigerant or the operating fluid flows in the passage. Therefore, the refrigerant or the operating fluid flowing in the fluid is more efficiently made by the carbon nanotube heating element.

Further, in the present invention, power is applied to the carbon nanotube heating element by the bimetal according to whether the carbon nanotube heating element is overheated. Therefore, the fluid can be more safely heated.

A second embodiment of a heating apparatus according to the present invention is described hereafter in detail with reference to the accompanying drawings.

Figure 4:
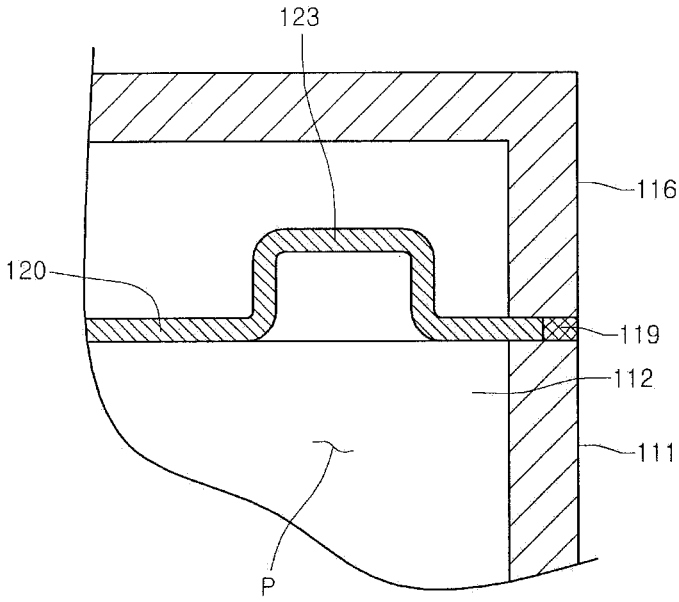
FIG. 4 is a longitudinal cross-sectional view showing the main part of a second embodiment of a heating apparatus according to the present invention.

FIG. 4 is a longitudinal cross-sectional view showing the main part of a second embodiment of a heating apparatus according to the present invention. In the components of this embodiment, the same components as the components of the first embodiment of the present invention described above are designated by the reference numerals of FIGS. 1 and 2, and a detailed description is not provided.

Referring to FIG. 4, in this embodiment, a plurality of reinforcement foaming portions 123 is provided in the heat transfer part 120. The reinforcement foaming portion 123 is formed by foaming a portion of the heat transfer part 120 to prevent thermal deformation of the heat transfer part 120. In this configuration, the reinforcement foaming portion 123 is formed by foaming a portion of the heat transfer part 120 toward the opposite side to the flow channel P, that is, the chamber cover 116, not the chamber main body 111. Accordingly, it is possible to minimize interference with the fluid flowing through the flow channel P by the reinforcement foaming portion 123 and also relatively increase the contact areas with the fluid flowing through the flow channel P.

A third embodiment of a heating apparatus according to the present invention is described hereafter in detail with reference to the accompanying drawings.

Figure 5:
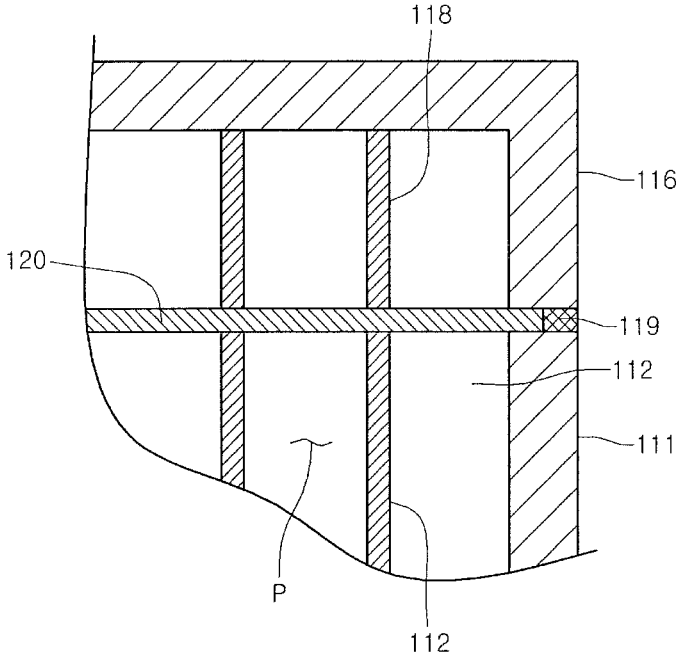
FIG. 5 is a longitudinal cross-sectional view showing the main part of a third embodiment of a heating apparatus according to the present invention.

FIG. 5 is a longitudinal cross-sectional view showing the main part of a third embodiment of a heating apparatus according to the present invention. In the components of this embodiment, the same components as the components of the first embodiment of the present invention described above are designated by the reference numerals of FIGS. 1 and 2, and a detailed description is not provided.

Referring to FIG. 5, in this embodiment, a plurality of reinforcement ribs 118 are provided on the inner side of the chamber cover 116. The reinforcement ribs 118 prevent thermal deformation of the heat transfer part 120. For this function, the reinforcement ribs 118 extend from the inner side of the chamber cover 116 and the front ends are in close contact with the other side of the heat transfer part 120. More preferably, it is preferable that the reinforcement rib 118 is formed at a position corresponding to any one of the section ribs 112. Accordingly, the heat transfer part 120 is pressed by the section rib 112 and the reinforcement rib 118, which correspond to each other, such that thermal deformation of the heat transfer part 120 can be more efficiently prevented.

According to a heating apparatus having the above configurations according to the present invention, the following effects can be expected.

First, in the present invention, fluid is heated by carbon nanotube heating elements. Therefore, it is possible to more efficiently heat the fluid with the carbon nanotube heating elements.

In the present invention, a heating chamber where a flow channel through which fluid flows and the carbon nanotube heating elements are formed in one unit. Therefore, the configuration of the heating apparatus is simplified and it is possible to easily install the heating apparatus.

Further, in the present invention, it is possible to connect and use a plurality of heating chambers in accordance with the needed heating amount. Therefore, it is easy to change the design of the heating apparatus in accordance with the needed heating amount.

Further, in the present invention, the sum of the contact areas of the heat transfer part where the plurality of carbon nanotube heating elements contacts with the fluid is determined 50% or more of the contact areas of the heat transfer part and the fluid. Further, the gap between the carbon nanotube heating elements is determined at the width of the carbon nanotube heating element, or less. Therefore, the carbon nanotube heating elements can maximally heat the fluid within a range that can prevent thermal deformation of the heat transfer part.

In addition, in the present invention, the flow channel through which the fluid flows entirely meanders and the carbon nanotube heating elements are disposed in parallel with the flow direction of the fluid through the flow channel. Therefore, the fluid flowing through the flow channel is more efficiently heated by the carbon nanotube heating elements.

Further, in the present invention, power is selectively applied to the carbon nanotube heating elements by bimetals, in accordance with whether the carbon nanotube heating elements are overheated. Therefore, it is possible to more safely heat the fluid.

What is claimed is:

1. A heating apparatus comprising:

a heating chamber having a flow channel through which fluid flows, the heating chamber comprising a chamber body having a groove and a chamber cover coupled to one side of the chamber body;

a heat transfer part mounted between the chamber body and the chamber cover, the heat transfer part having one side facing the chamber body and other side facing the chamber cover;

two electrodes connected to both sides of the heat transfer part;

a plurality of carbon nanotube heating elements that are disposed apart from each other on the other side of the heat transfer part and generate heat by power applied through the electrodes;

a bracket coupled to the heat transfer part;

at least one bimetal mounted on the bracket to selectively apply power to the carbon nanotube heating elements, in accordance with the temperature of the heat transfer part;

an insulating member provided at the other side of the heat transfer part to insulate the electrodes and the carbon nanotube heating elements; and a sealing member mounted between an edge of the chamber body and the chamber cover to prevent the fluid flowing through the flow channel from leaking, wherein the flow channel is defined by the groove of the chamber body and the one side of the heat transfer part, fluid flowing through the flow channel being contacted with a surface of the one side of the heat transfer part.

2. The heating apparatus according to claim 1, wherein the flow channel includes a plurality of straight sections and connecting sections that connect ends of adjacent straight sections, and the carbon nanotube heating elements are formed long in parallel with the straight sections.

3. The heating apparatus according to claim 2, wherein the carbon nanotube heating elements are spaced apart from each other in parallel with the straight sections, at a gap smaller than a width of the carbon nanotube heating elements in the parallel direction with the straight sections.

4. The heating apparatus according to claim 1, wherein the heating chamber further includes a plurality of section ribs that divide the inside of the chamber main body such that the flow channel entirely meanders.

5. The heating apparatus according to claim 4, wherein at least any one of the section ribs is formed thick in the flow direction of the fluid through the flow channel, as compared with other section ribs.

6. The heating apparatus according to claim 4, wherein the heat transfer part and the bimetal are fixed to at least one of a plurality of section ribs, which is provided in the heating chamber such that the flow channel entirely meanders.

7. The heating apparatus according to claim 1, wherein the heating chamber is composed of a plurality of heating chambers of which the flow channels are connected by a plurality of connecting tubes.

8. The heating apparatus according to claim 1, wherein the bimetal is fixed to other side of the heat transfer part, and the carbon nanotube heating elements are disposed on the other side of the heat transfer part, except for a portion of the other side of the heat transfer part where the bimetal is mounted.

9. The heating apparatus according to claim 1, wherein the heat transfer part comprises a reinforcement portion including a bending portion bent from the heat transfer part toward the chamber cover.

10. The heating apparatus according to claim 1, further comprises a reinforcement portion including an end coupled to the heat transfer part and the other end coupled to the chamber cover to prevent thermal deformation by heat generation of the carbon nanotube heating elements.

* * * * *